US007553109B2

(12) United States Patent
Blundell

(10) Patent No.: US 7,553,109 B2
(45) Date of Patent: Jun. 30, 2009

(54) HIGH FACE-AREA LOW-VOLUME CONCRETE WALL BLOCK, FORM AND METHOD

(76) Inventor: Peter J. Blundell, 815 NE. 172nd Ave., Vancouver, WA (US) 98685

( * ) Notice: Subject to any disclaimer, the term of this patent is extended or adjusted under 35 U.S.C. 154(b) by 0 days.

(21) Appl. No.: 11/866,290

(22) Filed: Oct. 2, 2007

(65) Prior Publication Data

US 2008/0085162 A1 Apr. 10, 2008

Related U.S. Application Data

(60) Provisional application No. 60/828,198, filed on Oct. 4, 2006.

(51) Int. Cl.
*B28B 7/20* (2006.01)

(52) U.S. Cl. ..... 405/286; 249/101

(58) Field of Classification Search ..... 405/284, 405/302.7, 286; 249/101
See application file for complete search history.

(56) References Cited

U.S. PATENT DOCUMENTS

D464,440 S * 10/2002 Risi et al. ..... D25/113
6,457,911 B1 * 10/2002 Scales et al. ..... 405/262
6,679,656 B1 * 1/2004 Manthei ..... 405/284
6,796,098 B2 9/2004 Hampton
6,829,867 B2 12/2004 Gresser et al.
7,073,304 B2 7/2006 Hampton et al.
2001/0019684 A1 * 9/2001 Manthei et al. ..... 405/284
2003/0160147 A1 * 8/2003 Manthei ..... 249/171
2004/0022587 A1 * 2/2004 Conkel et al. ..... 405/284

OTHER PUBLICATIONS

Redi-Rock Installation Manual Jan. 2007 Edition. Retrieved Oct. 2, 2007, from Redi-Rock International website: http://www.redi-rock.com.

V-Rod Product Data Sheet. Retrieved Oct. 2, 2007, from Concrete Protection Products, Inc. website: http://www.fiberglassrebar.com.

* cited by examiner

*Primary Examiner*—John Kreck
(74) *Attorney, Agent, or Firm*—Marger Johnson & McCollom, P.C.

(57) ABSTRACT

A retaining wall block and method of forming a retaining wall block are provided. The block includes front, back, top, bottom and side surfaces. The top surface of the retaining wall block includes a set of protrusions and the bottom surface includes a channel for engaging with the protrusions of adjacent blocks. Side surfaces of the block are tapered from the front surface to the back surface. A block form and a method of securing a stabilizing sheet to a block are also provided.

8 Claims, 6 Drawing Sheets

HIGH FACE-AREA LOW-VOLUME CONCRETE WALL BLOCK, FORM AND METHOD

RELATED APPLICATION DATA

This application claims the benefit of U.S. Provisional Application Ser. No. 60/828,198, filed 4 Oct. 2006, which is hereby incorporated by reference in its

BACKGROUND

1. Technical Field

The present invention pertains to retaining wall blocks, methods of manufacturing retaining wall blocks, and methods of assembling retaining walls. More particularly the present invention relates to cast segmental retaining wall blocks, methods of manufacturing cast segmental retaining wall blocks, and methods of assembling retaining walls using the cast segmental retaining wall blocks.

2. Description of the Related Art

Retaining walls are generally made by stacking blocks in a staggered configuration and then filling in the area behind the blocks with a fill material. An upper block is usually stacked on two lower blocks such that the upper block straddles the seam between the two lower blocks. The blocks are typically stacked such that they incorporate a setback, also called a batter, such that the retaining wall has a sloped face. In other words, lower blocks in the retaining wall will project further than upper blocks.

Various methods are used to ensure the mechanical stability of retaining walls. For instance, the blocks typically have protrusions of some kind projecting from their top surfaces, and corresponding depressions in their bottom surfaces. When the blocks are stacked, the protrusions from lower blocks engage with the depressions of upper blocks, thereby providing mechanical stability to the retaining wall. Another method of mechanically stabilizing a retaining wall is to use a stabilizing sheet. The stabilizing sheets are generally placed between upper and lower blocks and extend outward from the back of the retaining wall. In conjunction with the fill material, the stabilizing sheets provide mechanical stability to the retaining wall. According to conventional systems, stabilizing sheets extend across an entire level of blocks (referred to as 100% coverage) and are held in place by metallic rebar rods, plastic tabs, and the like. When used, the metallic rebar rods are generally installed in a side-by-side configuration (i.e. two rods are side-by-side in a single channel in the blocks). Unfortunately, the conventional metallic rebar rods are susceptible to corrosion, which may degrade the mechanical stability over time. Also, the side-by-side configuration of conventional systems allows physical forces from the retaining wall and fill material to act against the rods in such a way that the mechanical stability is weakened. Finally, using 100% coverage of the stabilizing sheets increases the cost of the retaining wall.

It is often desirable for a retaining wall to have some curvature rather than being perfectly flat across their face. The amount of curvature that a block will allow is determined by the design of the block. Specifically, the manner in which the protrusions of lower blocks engage with the depressions of upper blocks in the levels of the retaining wall will limit the amount of curvature allowable in the wall. The angle that side faces of the blocks make with front faces of the blocks will also play a role in the radius of curvature that can be obtained by a specific block design. Conventional block designs may only allow radii of curvature of around 15 feet or more, which may not be suitable for residential landscaping applications.

It is often desirable to provide some type of aesthetically pleasing features on the exposed faces of the blocks in a retaining wall. The features may include color and the faces are typically configured to simulate natural rock features or other aesthetically pleasing patterns.

In order to accomplish the functionality described above, retaining wall blocks are formed by a wet-cast technique in which concrete is poured into forms and allowed to harden, thereby producing a concrete block with the desired characteristics. The blocks are then removed from the forms (referred to as stripping) and may be cured for some amount of time before shipment to customers. Depending on the design of the forms, removing the blocks from the forms may be a multi-step process involving more than one crane lift per block. During the forming process, some type of lilting fixture is usually incorporated into the block in order to facilitate removal from the form and positioning at the site of the retaining wall. The lifting fixture may actually include more than one fixture in the case where more than one crane lift is required to remove the block from the form.

A complete retaining wall system generally includes several types of blocks performing specific functions in the wall. Full blocks are the primary type used and represent the majority of the blocks that will go into a wall. Half blocks are used at the ends of the wall to fill the gaps left by the staggered full blocks. If a retaining wall requires a corner, corner blocks are used at the corner. Finally, top blocks may be utilized in the very top layer of blocks in the retaining wall to give the wall a more aesthetically pleasing appearance. The complete retaining wall system may include any combination of the above-described blocks as will be dictated by the particular retaining wall application.

For several decades ready-mix concrete companies have been using their leftover concrete to cast blocks for storage bins and other forms of retention structures. The blocks were very crude and unsafe to use. In 1982, the LOCK-BLOCK® Retaining Wall System was developed in British Columbia, Canada. The block, which is made with leftover concrete, was configured to be able to build gravity walls and mechanically stabilized earth (MSE) walls. The block fits in a 2.5'×2.5'×5' envelope, weighs 4,300 lbs, requires 2.4 cubic feet of concrete per square foot of face, has over twenty different shapes, and has three standard facial finishes. 132 sq. ft. of block face is a normal truckload using the LOCK-BLOCK® system. The block does not lend itself to building walls with tight radii, and is too heavy to be used in most residential landscaping applications. The molds used to make this block are heavy and cumbersome to use.

In the late 1980's, a 2'×2'×4' interlocking block known as the Kelly Block was developed in Fife, Wash. The block weighs 2,200 lbs, requires 2 cubic ft. of concrete per sq. ft. of face area, and typically has a fractured fin face finish. 168 sq. ft. of block face is a normal truckload. The block can be used in both gravity and MSE walls. The block has limited architectural appeal, is difficult to use in radius walls, and has a form that is difficult to set up and strip because of block outs that create the internal holes in the block.

In the early 1990's, a company in Michigan developed a forming and retaining wall system, called REDI-ROCK®. The blocks fit into a 1.5'×3.8'×3.5' envelope, can weigh up to 2,400 lbs and require up to 2.9 cubic feet of concrete per sq. foot of wall face. 114 sq. ft of block face is a normal truckload. The system was developed to build gravity and MSE walls. The mold system is simple but expensive. The blocks require two hooks for casting, one in the back and one in the top.

Removing the block from the mold is a two step process: lifting the blocks straight up out of the mold using the hook on the back, since they are cast face down; laying the block down on its bottom side; and then re-lifting it using the hook on the top for stacking. The blocks can weigh as much as 2,400 lbs and can be used to build walls with a minimum 14.5' radius of curvature. A few years after the REDI-ROCK® was developed, a similar type of system, called RECON®, except with a different interlocking keyway system, was developed. Although both REDI-ROCK® and RECON® were developed to utilize leftover concrete, due to quality control problems, the blocks are precast using fresh concrete which has substantially increased the price of a block. For example, in Washington State, a REDI-ROCK® block would cost about 65 percent more per sq. ft. than a LOCK BLOCK®.

As described above, conventional retaining wall block systems have several drawbacks including: large envelopes limiting the amount of wall face that can be shipped to a job site in a truck load; low radius of curvature ability; and difficult manufacturing. Further, conventional retaining block forms suffer from several drawbacks including tedious stripping processes and excessive weight.

The present invention addresses these and other disadvantages of the conventional art.

SUMMARY

The retaining wall system according to an embodiment of the invention is a wetcast block system that can be used to build gravity walls up to 8' high and MSE wall systems up to 50' high. The block fits into a 2'×2'×4' envelope. The full block has 8 sq. ft. of face area and weighs 1,700 lbs and requires a maximum 1.6 cubic ft. of concrete per square foot of face area. The forming system according to embodiments of the invention is an inexpensive three piece hinged form that allows easy stripping, setup, and pouring of blocks.

BRIEF DESCRIPTION OF THE DRAWINGS

The above and other objects, features and advantages of the disclosure will be more clearly understood from the following detailed description taken in conjunction with the accompanying drawings, in which.

DETAILED DESCRIPTION

Figure 1:
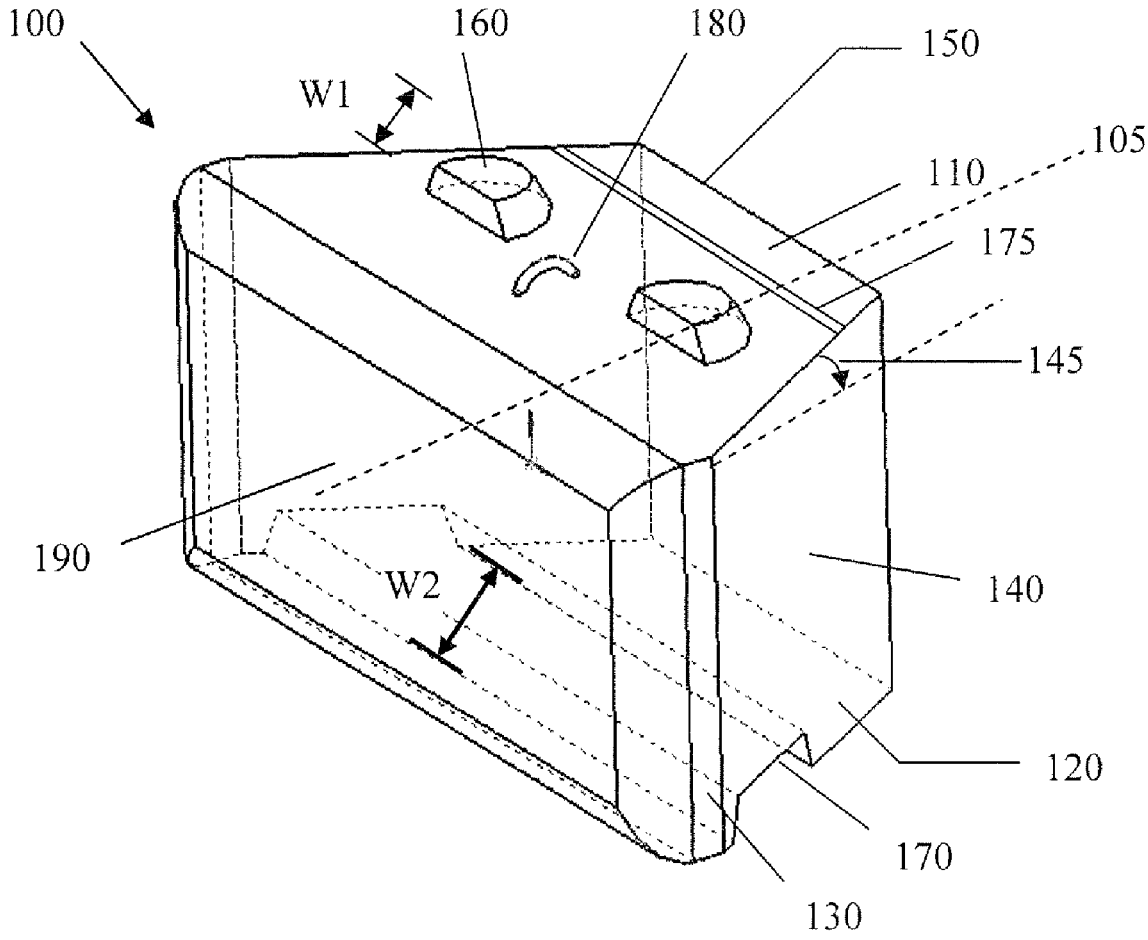
FIG. 1 is a perspective view of a retaining wall full block according to an embodiment of the invention.

Example embodiments of the invention are described below with reference to the accompanying drawings. Many different forms and embodiments are possible without deviating from the spirit and teachings of this disclosure and so the disclosure should not be construed as limited to the example embodiments set forth herein. Rather, these example embodiments are provided so that this disclosure will be thorough and complete, and will fully convey the scope of the disclosure to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

The terminology used herein is for the purpose of describing particular example embodiments only and is not intended to be limiting. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one skilled in the art to which this disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a perspective view of a retaining wall full block according to an embodiment of the invention.

Referring to FIG. 1, a retaining wall full block 100 includes a front face 190, which is the surface that is visible when the block is placed in a retaining wall. The configuration of the front face 190 may be created by a liner pan 300 (shown in FIG. 3) placed in the block form when the block is manufactured and may include indentations, protrusions, and/or other design markings. The front face 190 may also be colored as desired, for example with paint or stain. The purpose of the front face 190 is to provide an aesthetically pleasing appearance. The block 100 may be symmetrical about a centerline 105 running through the front face 190 and a back face 150.

The retaining wall full block 100 also includes a top face 110 and a substantially parallel bottom face 120. The top face 110 is the face facing up when the retaining wall block 100 is positioned in a retaining wall. The bottom face 120 is the face facing down when the retaining wall block 100 is positioned in a retaining wall. The top face 110 is configured to engage the bottom face of an overlying block, as described in detail below.

The retaining wall full block 100 further includes first side face portions 130 arranged on opposite sides of the block 100 adjoining the front face 190. The block 100 has second side face portions 140 also arranged on opposite sides of the block 100 rearward of the first side face portions 130. The opposite side faces may be substantially mirror images of one another. According to some embodiments of the invention, the first side face portions 130 are substantially perpendicular to the front face 190. The second side face portions 140 adjoin the first side face portions 130. The second side face portions 140 may create an angle 145 with a plane perpendicular to the front face 190 in a range of about 30 to about 40 degrees. According to an example embodiment, the second side face portions 140 create an angle 145 with a plane perpendicular to the front face 190 of about 32.3 degrees The retaining wall full block 100 also includes a back face 150 opposite to and approximately parallel with the front face 190. The back face 150 faces the fill material, or what is behind the retaining wall.

The retaining wall full block 100 also includes two partial frustum-shaped conical knobs 160 protruding from the top face 110 of the block 100. The knobs 160 may be symmetrically spaced relative to the centerline 105 of the block 100 and spaced substantially the same distance from the front face 190. The full block 100 also includes a first transverse channel 170 in the bottom face 120 of the block. The knobs 160 are configured to fit within a first transverse channel 170 of an overlying block and such overlying block might be a full block, half block, top block or corner block. The highest protruding extent of a knob 160 may be less than the depth of the first transverse channel 170 in an overlying block. The first transverse channel 170 extends parallel to the front face 190 and is spaced closer to the front face than the knobs 160. In this way, an overlying block may be placed onto a lower block with the knob 160 of the lower block positioned within the first transverse channel 170 of the upper block. The alignment of the conical knobs 160 in relation to the first transverse channel 170 on an overlying block creates a natural internal batter when the blocks are stacked, and sets back the overlying block rearwardly of the lower block. In this way, the retaining wall built by stacking the blocks 100 will have a slope. As an example, the knobs 160 have a first width W1, the first transverse channel 170 has a second width W2, and the first width W1 is less than the second width W2. The difference between the width W1 and the width W2 may allow retaining walls with different batters to be built. For instance, according to some embodiments, the difference between the width W1 and the width W2 may allow retaining walls to be built with a batter in the range of about 1:24 (corresponding to a 1" setback) to about 1:12 (corresponding to a 2" setback).

In order to move and maneuver the retaining wall blocks 100, a lifting loop 180 may be incorporated into the top face 110 that can be latched onto for lifting the block 100. The loop 180 is positioned close to the centerline 105 and includes a material of sufficient strength to support the weight of the block 100. Thus, the loop 180 may comprise iron or steel. For instance, the loop 180 may comprise galvanized steel. The loop 180 may be coated with a plastic material to prevent corrosion.

In order to enable construction of MSE walls, the retaining wall full block 100 may include a second transverse channel 175 disposed in the top face 110 of the block 100 spaced between the knobs 160 and the back face 150. The second transverse channel 175 may have a width slightly larger than a retaining rod and a depth slightly larger than two retaining rods, as described in detail below. For example, the second transverse channel 175 may have a width of about 0.88 inches, a depth of about 1.13 inches, and a length extending transversely from one side of the block 100 to the opposing side. The second transverse channel 175 may be disposed farther from the front face 190 than the knobs 160.

The retaining wall full block 100, according to some embodiments of the invention is a wetcast block that can be used to build gravity walls up to 8' high and MSE wall systems up to 50' high. As an example, the block 100 may fit into a 2'×2'×4' envelope. The block 100 has about 8 sq. ft. of face area, weighs about 1,700 lbs, and requires a maximum 1.6 cubic ft. of concrete per square foot of face area. A face area ratio is defined as the ratio of the volume of concrete need to form a block divided by the face area of the block. Accordingly, the face area ratio of the block 100, according to some embodiments, is less than 2 feet. Conventional retaining wall blocks have a face area ratio of greater than 2 feet and may be 3.4 feet or higher.

Figure 2A:
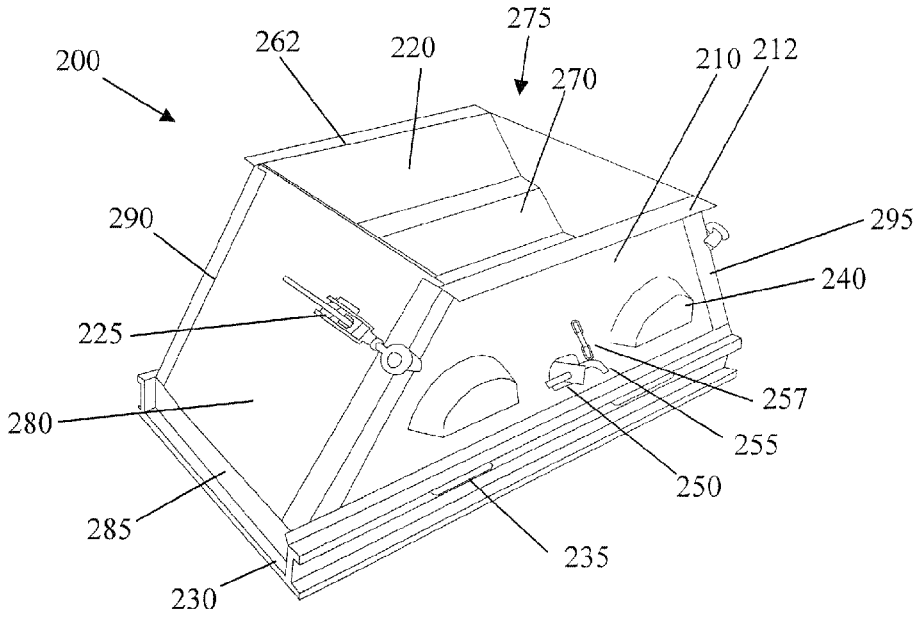
FIGS. 2A and 2B are perspective views of a block form in accordance with an embodiment of the invention.
Figure 2B:
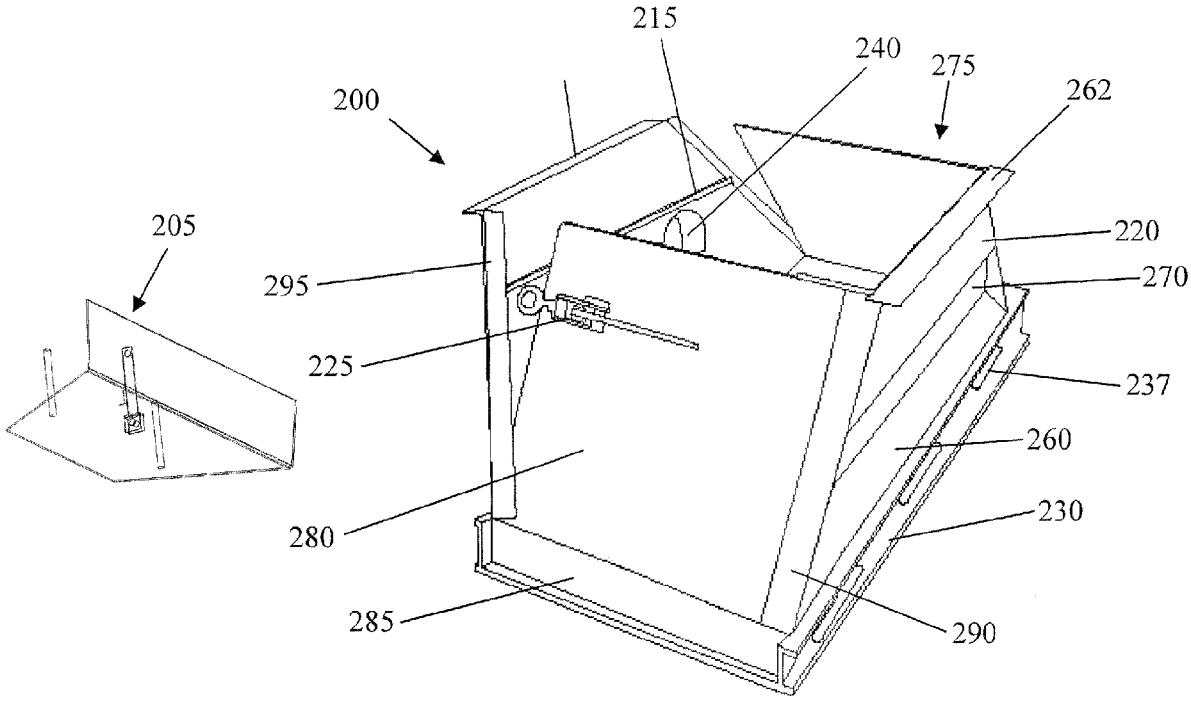

FIGS. 2A and 2B are perspective views of a block form in accordance with an embodiment of the invention.

A block form, according to an embodiment of the invention, for molding retaining wall blocks, such as the blocks described above, will now be described. The block form described herein is not intended to be limited to forming the blocks 100 described above. Other shapes of blocks can be made by varying the shape of the block form described herein.

Referring to FIGS. 2A and 2B, a block form 200 in accordance with an embodiment of the invention includes two sections and a base frame. The first section is called the top section 210 and is discussed in detail below. The second section is called the side and bottom or simply the bottom section 220 and is also discussed in detail below. A base frame 230 supports the two sections and a formed liner pan 300 (shown in FIG. 3). The two sections 210 and 220 and the base liner 300, when closed and locked together with a latching mechanism 225, form an enclosure into which moldable concrete can be poured through rectangular opening 275 and allowed to solidify.

According to an embodiment of the invention, the block form 200 further includes top hinges 235 (shown in FIG. 2A) connecting the top section 210 to the base frame 230 and bottom hinges 237 (shown in FIG. 2B) connecting the bottom section 220 to the base frame 230. The top and bottom hinges 235 and 237 allow a finished block to be easily removed from the block form 200, as is described in detail below. The latching mechanism 225 that secures the top 210 and bottom 220 sections together is configured to be releasable such that the top section 210 may be rotated back from the top face of a block.

The block form 200 may also include fabricated partial conical frustums 240 welded to the outside of the top section 210. The inside conical area of the frustums 240 may have no negative relief to enable easy stripping of a block from the block form 200.

According to an embodiment of the invention, the block form 200 is an assembly made up of several distinct components. The base frame 230 may be constructed of steel channel, formed into a rectangle with full weld at each corner. The base frame 230 may be configured to have a single station for forming a single block or it may be configured to provide a plurality of stations for forming a plurality of blocks substantially simultaneously. When the base frame 230 includes a plurality of stations, it may be referred to as a gang form base frame. The top section 210 may be constructed of steel plate, typically 3/16" thick, which is cut and broke at the top and bottom to create flanges 212. The top section 210 is attached to one long side of the base frame 230 by heavy-duty top hinges 235. A figure eight slotted hole (not shown) may be cut into the center of the top section 210 and then the area around it is heated and pressed in to form a recess 250. The recess 250 allows a lifting hook to be passed through the recess 250 such that the lifting hook can be incorporated into a block when the block is formed. A retaining pin 255 may be attached to the top section 210 by a chain 257. The retaining pin 255 allows a lifting hook to remain above the cast surface during pouring of concrete into the block form 200. The retaining pin 255 may be formed from a piece of round bar stock that is bent at 90 degrees, one inch in from one end. The other end of the bar stock may be welded to the end of the close link chain 257 and the other end of the chain 257 may be welded or connected to the block form 200.

The bottom section 220 may include a bottom plate 260 (shown in FIG. 2B) and a bottom ridge 270 that forms a channel along the bottom of a block. The bottom ridge 270 may have a trapezoidal shape, resulting in a trapezoidal channel in the bottom of a block. Although the bottom ridge 270 is shown as trapezoidal, the bottom ridge 270 may have any shape that does not result in negative relief. A bottom ridge 270 having negative relief would make the block difficult to strip from the block form. The bottom plate 260 may be constructed of steel plate that is cut and broke to create flanges 262 at the top and bottom of the plate. Two steel side plates are broke at the bottom to create straight sections 285 and then welded to the bottom plate 260 as shown to create the side plates 280 of the block form 200. The long side of the bottom plate 260 is attached with bottom hinges 237 and steel angle to the base frame 230 opposite to the side of the base frame 230 to which the top section 210 is attached. Steel angle sections 290 are attached to cover and strengthen the joints between the side plates 280 and the bottom plate 260. The top section 210 includes welded angle plates 295 at the corners that overlap the side plates 280 when the block form 200 is closed. The top section 210 may also include a top ridge 215. The top ridge 215 may have a substantially trapezoidal cross-section shape.

The block form 200 may also include an insert 205. The insert 205 may be used to form top blocks by displacing concrete from a portion of the form during forming of the top blocks. Specifically, when it is desired to create a top block, the insert 205 is inserted into the block form 200, prior to filling with concrete. In this way, a portion of the block form 200 will be blocked off by the insert 205, such that the resulting block will have a shelf-type shape. The block form may also include stop blocks (not shown) or other mechanisms, such as snap rings, for preventing the hinges from coming apart when the top and bottom sections 210 and 220 are rotated. Hammer points (not shown) may also be incorporated into the top section 210 of the block form 200 in order to facilitate opening of the top section 210 after forming a block.

One possible use of a block form 200 is for capturing moldable returned concrete such as wetcast concrete. Returned concrete is concrete that is left over after a concrete pouring project is completed. This left over concrete can be returned to the ready mix plant or to some other location and poured into a block form instead of going to a landfill or being disposed of in some other manner. In this way, block forms in accordance with embodiments of the invention can promote a cleaner environment and avoid wasting valuable concrete. The use of returned concrete is one exemplary application of the block forms in this invention. However, the block forms of this invention are not limited to being used with returned concrete.

Figure 3:
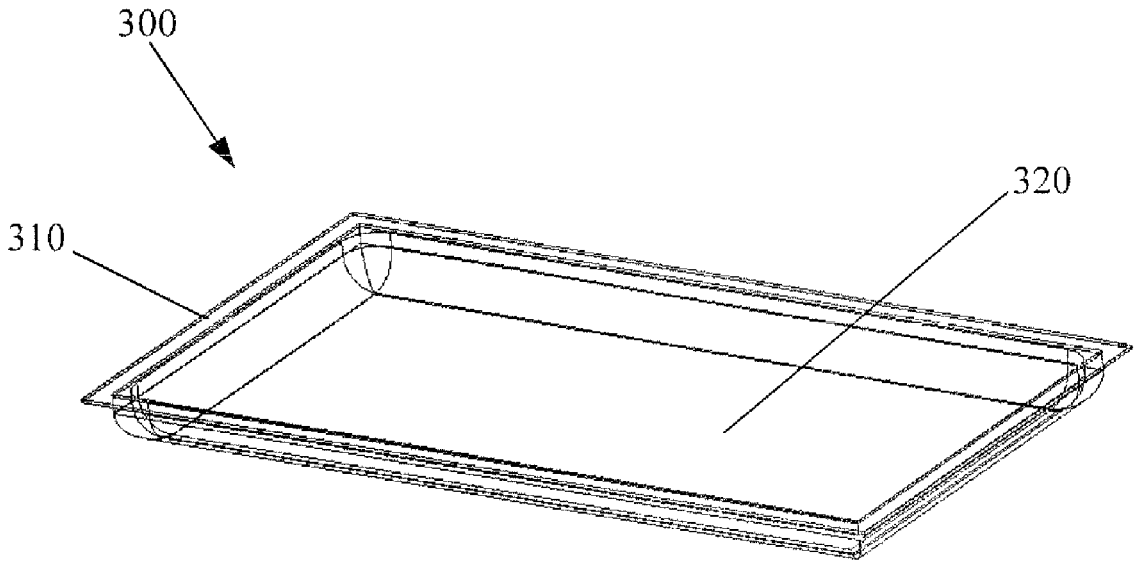
FIG. 3 is a perspective view of a liner pan for use with a block form according to an embodiment of the invention.

FIG. 3 is a perspective view of a liner pan for use with a block form according to an embodiment of the invention.

Referring to FIG. 3, a liner pan 300 may include lipped edges 310 and a face surface 320. The liner pan 300 is configured to engage with a base frame 230 of a block form 200. The lipped edges 310 provide a seal between the top section, bottom section and the base frame of a block form when a block is formed. According to some embodiments, a mesh (not shown) is used in conjunction with the liner pan 300 to provide support for the liner pan 300 during forming of a block. The mesh may comprise a metal grid. The liner pan 300 may comprise ABS plastic. The face surface 320 may include a texture, a pattern, or be substantially flat. The face surface 320 of the liner pan 300 will determine the characteristics of the front face of blocks formed in the block form and so the face surface 320 may contain a texture or pattern that is aesthetically pleasing and/or functional. The liner pan 300 used for forming a particular block may be selected from a plurality of liner pans, each having a different design or texture on their face surface.

Referring again to FIGS. 2A and 2B, a method of forming a retaining wall block according to an embodiment of the invention will now be described. First, the block form 200 is assembled. A liner pan 300 (shown in FIG. 3) is placed in the block form 200 such that the liner pan 300 engages with the base form 230. The liner pan 300 may also engage with a mesh welded into the block form 200. The bottom section 220 is then pivoted about bottom hinges 237 so as to engage with the base frame 230 and the liner pan 300. The top section 210 is then pivoted about top hinges 235 so as to engage with the bottom section 220 and the liner pan 300. Latching mechanisms 225 are then engaged to hold the top section 210 and the bottom section 220 together. A lifting hook is then placed in the recess 250 and held in place by retaining pin 255.

Once the block form 200 is assembled, a release agent may be sprayed into the block form 200 to assist in the removal of the finished block. Then, concrete is poured into the block form 200. The concrete is allowed to solidify for a predetermined period of time. The concrete also may be allowed to cure for another predetermined period of time. Once the concrete is cured, the block can be removed, or stripped, from the block form. First, the latching mechanisms 225 that secure the top section 210 and the bottom section 220 together are released. The retaining pin 255 is also removed from the lifting hook. The top section 210 is then rotated back from the top face of the block. A piece of equipment that has a lifting system with an adequate lift capacity is connected to the lifting hook in the block. The block is then lifted out of the block form 200. As the block is lifted the bottom section 220 of the block form 200 pivots back and the block separates from the bottom section 220 and the liner pan 300. Once the block is removed, the block form may then be reassembled allowing the block forming process to be repeated. Contrary to conventional methods of forming blocks, embodiments of the invention allow the block to be stripped from the block form in a single step. Therefore, blocks formed in accordance with embodiments of the invention require only a single lifting hook.

FIGS. 4A through 4F are cross-sectional views illustrating a method of securing a stabilizing sheet to a retaining wall block according to an embodiment of the invention.

Figure 4A:
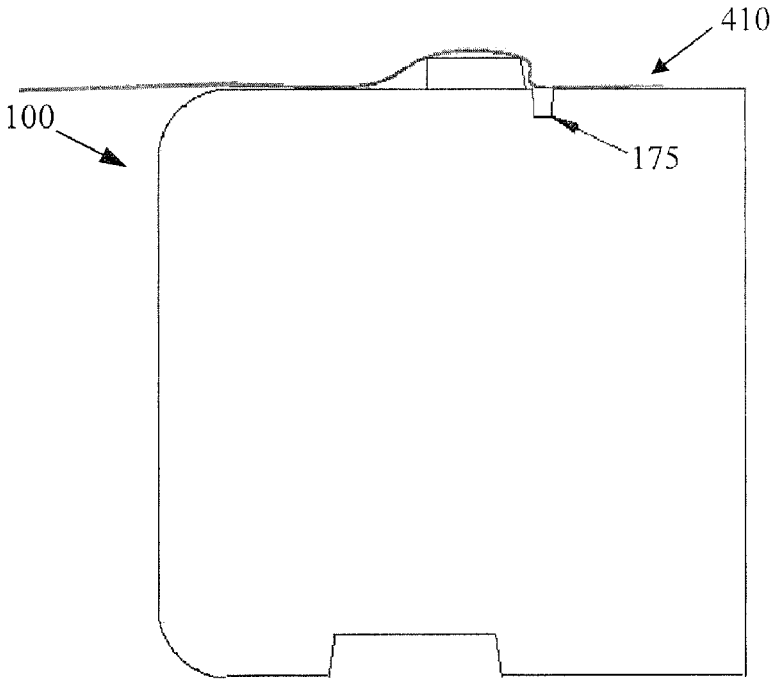
FIGS. 4A through 4F are cross-sectional views illustrating a method of securing a stabilizing sheet to a retaining wall block according to an embodiment of the invention.

Referring to FIG. 4A, a block 100, having a second transverse channel 175, is provided. A stabilizing sheet 410 is placed on the block 100 over the second transverse channel 175. The stabilizing sheet 410 may be any type of commercially available high-strength geo-synthetic fabric grid and may be referred to as geogrid. Contrary to conventional methods, the stabilizing sheet 410 may only cover a partial width of the block 100. As an example, according to embodiments of the invention, the stabilizing sheet may only provide 60% coverage of the width of the block 100. Using 60% coverage may result in a cost savings of 20% or more compared with conventional systems.

Figure 4B:
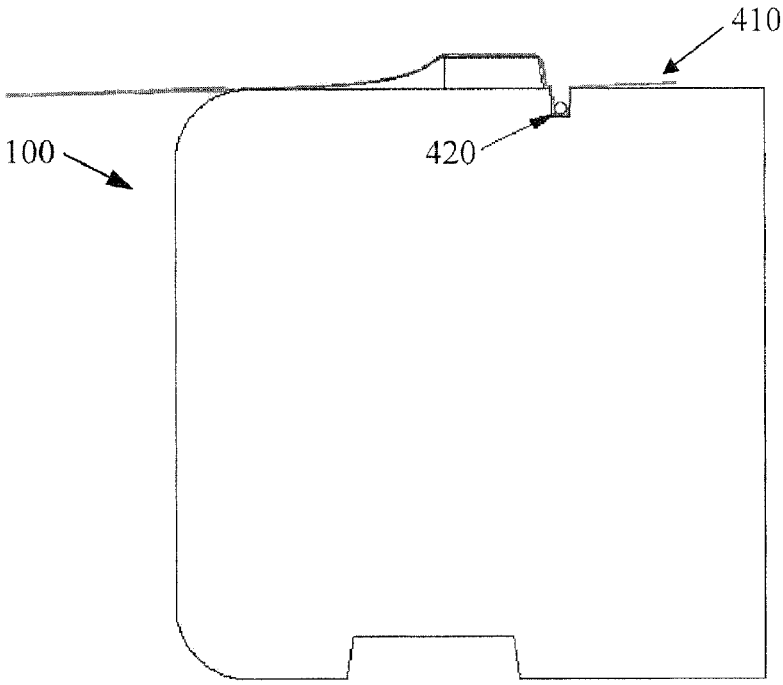

Referring to FIG. 4B, a first rod 420 is placed on the stabilizing sheet 410 over the second transverse channel 175. The first rod 420 is then pushed into the second transverse channel 175, thereby depressing a portion of the stabilizing sheet into the second transverse channel 175. The first rod 420 may comprise a metal rebar. Alternatively, the first rod 420 may comprise a fiberglass rebar. The fiberglass rebar may include a silica coating to improve the engagement of the first rod 420 with the block 100 and/or the stabilizing sheet 410.

Figure 4C:
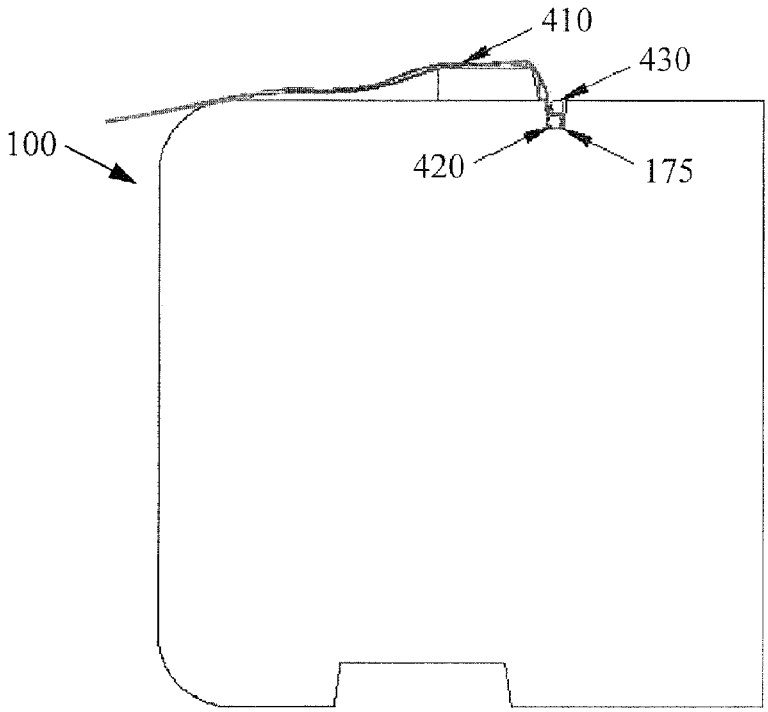

Referring to FIG. 4C, the stabilizing sheet 410 is folded toward the front face of the block 100. A second rod 430 is then inserted into the second transverse channel 175. The second rod 430 may be substantially identical with the first rod 420.

Figure 4D:
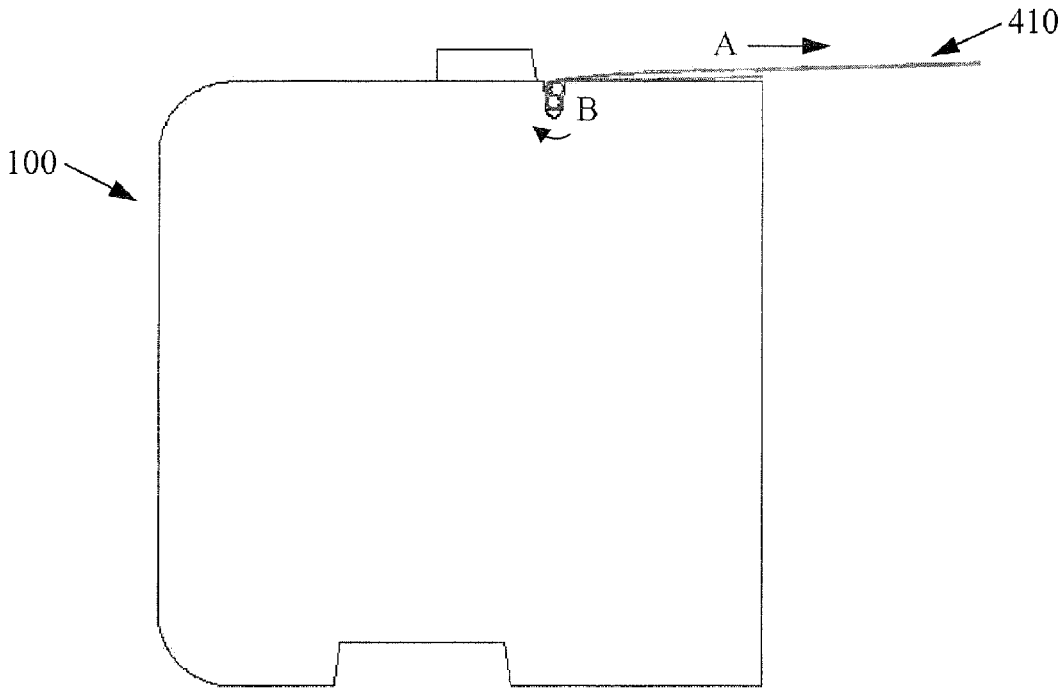
Figure 4E:
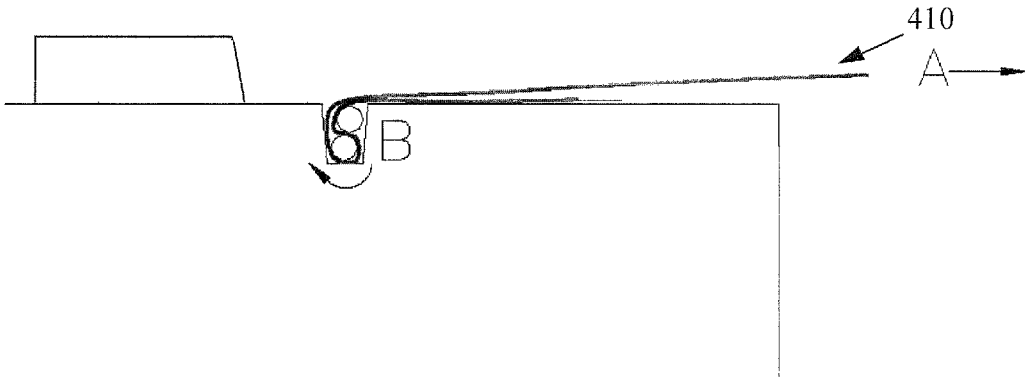
Figure 4F:
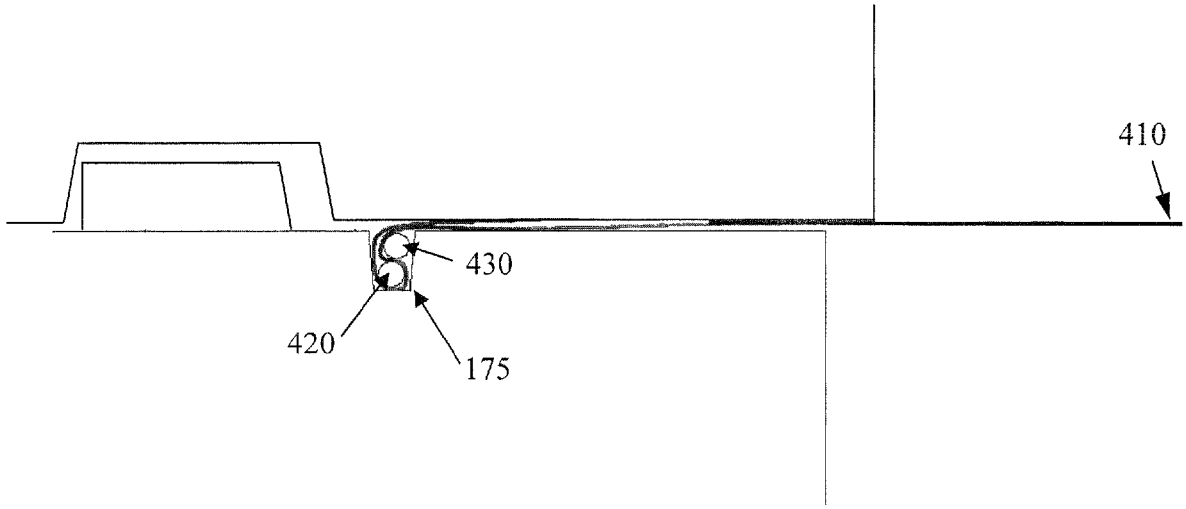

Referring to FIGS. 4D-4F, the stabilizing sheet 410 is folded back toward the back face of the block 100. A second block is then placed on the block 100, thereby securing the stabilizing sheet 410, the first rod 420, and the second rod 430 in the second transverse channel 175, as shown in FIG. 4F.

According to embodiments of the invention, the first and second rods 420 and 430 are arranged in a top-to-bottom configuration, as opposed to the side-by-side configuration of conventional systems. As shown by the arrow A in FIGS. 4D and 4E, physical forces in the retaining wall and fill material will act to pull the stabilizing sheet 410 out of the second transverse channel 175. However, according to embodiments of the invention, the top-to-bottom configuration of the first and second rods 420 and 430 will transform the physical forces into rotational forces (shown by arrows B), which will cause the rods to further engage with block 100 rather than being pulled out of the second transverse channel 175. In this way, the physical forces act to enhance the mechanical stability of the retaining wall.

Advantages of the block retaining wall system of the present invention include one or more of the following:

- More square footage of block face can be made per cubic yard of concrete material.
- More square footage of block face can be loaded on a truck.
- The low weight of the block requires smaller equipment to install, which makes the block more attractive to small landscape contractors and installations.
- Inexpensive forming system.
- Form system that is easy to set up and strip.
- ABS vacuum form liners can be easily interchanged to give different architectural finishes to the blocks.
- A reduced amount of stabilizing sheet can be used while still providing excellent mechanical stability.

The foregoing is illustrative of the invention and is not to be construed as limiting thereof. Although a few example embodiments of the invention have been described, those skilled in the art will readily appreciate that many modifications are possible in the example embodiments without materially departing from the novel teachings and advantages of the invention. Accordingly, all such modifications are intended to be included within the scope of the invention as defined in the claims. The invention is defined by the following claims, with equivalents of the claims to be included therein.

I claim:

1. A block form, comprising:

a base frame configured to engage a selected one of a plurality of liner pans;

a top section attached to the base frame by one or more top hinges;

a bottom section attached to the base frame by one or more bottom hinges, the bottom section including:

a bottom plate;

a bottom transverse ridge disposed in the bottom plate; and two side plates welded to the bottom plate, the side plates including a first portion having a first angle with respect to the base frame and a second portion having a second angle with respect to the base frame;

one or more latching mechanisms configured to releasably secure the top section to the bottom section;

two or more protrusions disposed on the top section;

a top transverse ridge disposed in the top section; and a recess disposed in the top section substantially between the protrusions.

2. The block form of claim 1, further comprising a retaining pin attached to the top section by a chain.

3. The block form of claim 1, wherein the protrusions have a partial conical frustum shape with a flat face, the flat face being substantially parallel with the base frame.

4. The block form of claim 1, wherein the bottom transverse ridge has a substantially trapezoidal cross-section shape.

5. The block form of claim 1, wherein the bottom section further comprises one or more angle sections configured to reinforce a joint between the bottom plate and the side plates.

6. The block form of claim 1, wherein the top section further comprises one or more angle plates disposed at side portions of the top section and configured to engage the side plates of the bottom section when the block form is closed.

7. The block form of claim 1, wherein the base frame includes a plurality of stations configured to form a plurality of blocks substantially simultaneously.

8. The block form of claim 1, wherein the base frame is further configured to engage with a mesh to support the selected liner pan.

* * * * *